US008720893B2

(12) United States Patent
Bridge

(10) Patent No.: US 8,720,893 B2
(45) Date of Patent: May 13, 2014

(54) THREE TRUMPS CARD GAME

(71) Applicant: Matthew Bridge, Basingstoke (GB)

(72) Inventor: Matthew Bridge, Basingstoke (GB)

( * ) Notice: Subject to any disclaimer, the term of this patent is extended or adjusted under 35 U.S.C. 154(b) by 0 days.

(21) Appl. No.: 13/860,725

(22) Filed: Apr. 11, 2013

(65) Prior Publication Data

US 2013/0281172 A1 Oct. 24, 2013

Related U.S. Application Data

(63) Continuation-in-part of application No. 12/499,594, filed on Jul. 8, 2009, now abandoned.

(51) Int. Cl.
*A63F 1/00* (2006.01)

(52) U.S. Cl.
USPC ..... 273/292

(58) Field of Classification Search
None
See application file for complete search history.

(56) References Cited

U.S. PATENT DOCUMENTS

| | | | | | |
|---|---|---|---|---|---|
| 4,234,189 | A * | 11/1980 | Chunn | 273/299 |
| 4,369,976 | A * | 1/1983 | Chunn | 273/303 |
| 5,791,652 | A * | 8/1998 | Nielsen | 273/305 |
| 5,944,314 | A * | 8/1999 | Stavinsky | 273/292 |
| 6,095,520 | A * | 8/2000 | Willkow | 273/141 R |
| 6,543,774 | B1 * | 4/2003 | Taylor | 273/292 |
| 7,156,398 | B1 * | 1/2007 | Phillips | 273/292 |
| 7,222,853 | B2 * | 5/2007 | Duse | 273/274 |
| 2010/0013157 | A1 * | 1/2010 | Marquez et al. | 273/292 |

* cited by examiner

*Primary Examiner* — Kurt Fernstrom
*Assistant Examiner* — Dolores Collins
(74) *Attorney, Agent, or Firm* — J P Webb; Jason P. Webb; Danny Y. H. Cheng

(57) ABSTRACT

A card game and a method of playing a card game. There is a dealer and at least one player, who must make a base wager. The dealer deals a hand of three cards to all players, who must then make a further wager in order to participate in play. A trump suit is determined. The dealer leads a card from his hand, and the players try to beat this card by playing a higher card of the same suit, or a trump card. The payout is calculated by a pre-determined formula based on the number of tricks won per player. An optional bonus wagering scheme is disclosed, whereby players can wager on the cards in their hands before having sight of them.

8 Claims, 2 Drawing Sheets

THREE TRUMPS CARD GAME

CROSS-REFERENCE TO RELATED APPLICATIONS

This application is a Continuation in Part Application of, under 35 U.S.C. §120, and claims priority to, under 35 U.S.C. §120, U.S. Non-Provisional application Ser. No. 12/499,594, entitled THREE TRUMPS CARD GAME, by Bridge, filed on 8 Jul. 2009.

BACKGROUND OF THE INVENTION

1. Field of the Invention

The present invention relates to card games, specifically to card games played against a dealer 2. Description of the Related Art Card games have been a highly popular form of entertainment for centuries. For many individuals, an added excitement of wagering and a possibility of a monetary reward serve to increase the entertainment value and desirability of the game. Card games have become especially popular with players of gaming machines.

However, existing games have limited requirement for skill during gameplay, lessening the excitement and challenge of the game for the player. In addition, these games also have limited pay out options in terms of a monetary value and total number of possible winning combinations. Furthermore, the majority of gambling games are based on variations of poker, limiting their appeal.

Therefore, a need exists to provide a card game in which players have a certain degree of control over the results of the game which are in the form of play options and decision making opportunities. Furthermore, it is desirable to provide a card game in which players have an opportunity, through player options, to increase pay out options in terms of a monetary value and total number of possible winning combinations. It is further desirable to provide a gambling game which has an acceptable margin for the casino or other organization running the game.

The game of whist is very popular as a form of entertainment. Whist, in its broadest sense, refers to any game involving players sequentially exposing a card from a hand concealed from the other players, with the objective of winning "tricks" by playing the card having the highest numerical value. Thus far, whist has not proved popular in a casino or gaming setting, as in known forms game-play is too slow to provide a sufficiently rapid turnover for the casino, or sufficient excitement for the player.

The inventions heretofore known suffer from a number of disadvantages which include being too slow, difficult to learn and/or play, difficult to adapt to a gaming setting, failing to entertain, failing to incorporate skill, and etc.

What is needed is a card game that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available card games. Accordingly, the present invention has been developed to provide an improved card game including one or more of the features described below and/or excluding one or more of the features described below and or features not described herein.

It is an object of the invention to provide a trick winning game for use in casinos and other gaming venues which has more rapid gameplay than previously known versions, whilst at the same time allowing for an element of player skill which is lacking in other casino games.

The present invention is directed to a card game and to a game of chance and method of playing the game which involves a variation of a conventional trick winning game. The present game may be played between a dealer who represents a banker, such as casino employee, and one or more players. However, the game may also be played electronically between a player and a video or image display controlled by appropriate computer, for example over the internet.

The game is initiated by a player placing a preliminary wager against the dealer or the house after which the dealer deals three cards to each player, including the dealer. The trump suit is determined in one variation of the game by turning over a further card. Thereafter, the players assess the value of their hands, and may either decide to participate in that hand, in which case they are required to make a further wager, or they can elect to withdraw from that hand, in which case they lose their preliminary bet.

In one non-limiting variation of the game, the dealer does not inspect his hand, but instead plays it unseen (or "blind").

Play commences with the dealer leading a card from his hand, and placing it face up on the playing area so that it is visible to the players and the dealer. Each player then plays a card of his choosing from their hand. The players must follow suit (that is, play a card of the same suit as the dealer's card) if they are able. If they are not able to play a card of the same suit, they may either discard a card of another suit, or play a card of the trump suit. In one variation of the game, if a player is not able to play a card of the same suit, they must play a trump card if they have one in their hand.

Play continues until all the participating players have played a card. This is referred to as a "trick". The players can play their cards simultaneously to speed up the game, or alternatively each card may be played sequentially.

A player wins a trick by playing a card having the same suit as the dealer having a higher numerical value. Alternatively, a player can win a trick by playing a card of the trump suit. If the dealer leads a card of the trump suit, the player can only win the trick by playing a higher card of the trump suit. Every player that beats the dealer's card wins a trick. The players are only competing against the dealer. Therefore none, more than one or all the players could beat the dealer and win a trick each.

Play continues in this manner until all cards have been played. The number of tricks won by each player is totalized.

The payout received by each player is calculated on a predetermined formula based on the number of tricks that player has won. Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
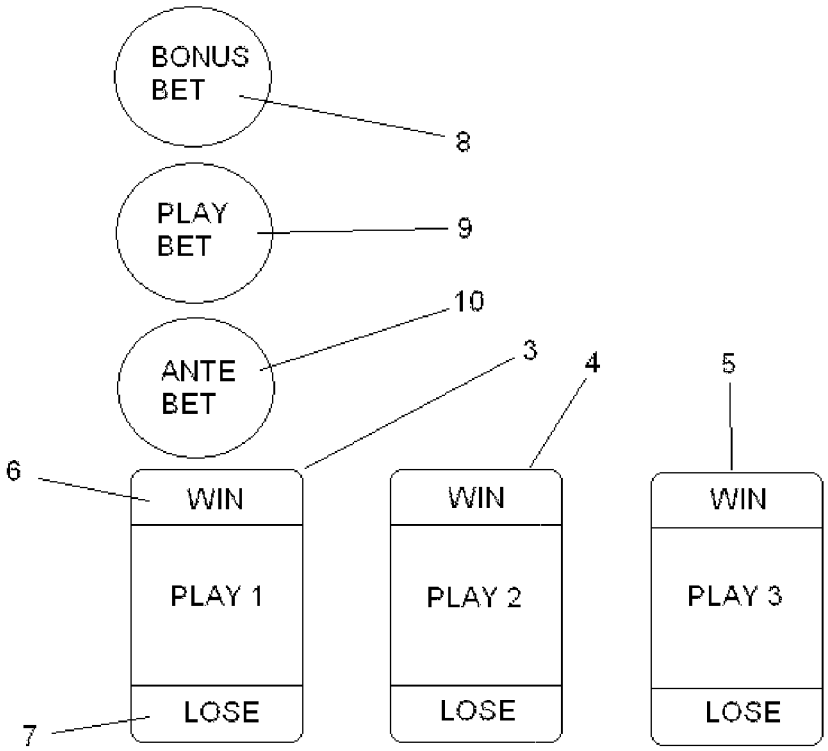
FIG. 1 is a plan view of a detail of a game table showing an individual player's station.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of programmable or executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module and/or a program of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

The various system components and/or modules discussed herein may include one or more of the following: a host server or other computing systems including a processor for processing digital data; a memory coupled to said processor for storing digital data; an input digitizer coupled to the processor for inputting digital data; an application program stored in said memory and accessible by said processor for directing processing of digital data by said processor; a display device coupled to the processor and memory for displaying information derived from digital data processed by said processor; and a plurality of databases. Various databases used herein may include: cards, user accounts, payout tables, rule-sets, user preferences, and/or like data useful in the operation of the present invention. As those skilled in the art will appreciate, any computers discussed herein may include an operating system (e.g., Windows Vista, NT, 95/98/2000, OS2; UNIX; Linux; Solaris; MacOS; and etc.) as well as various conventional support software and drivers typically associated with computers. The computers may be in a home or business environment with access to a network. In an exemplary embodiment, access is through the Internet through a commercially-available web-browser software package.

The present invention may be described herein in terms of functional block components, screen shots, user interaction, optional selections, various processing steps, and the like. Each of such described herein may be one or more modules in exemplary embodiments of the invention. It should be appreciated that such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, the software elements of the present invention may be implemented with any programming or scripting language such as C, C++, Java, COBOL, assembler, PERL, Visual Basic, SQL Stored Procedures, AJAX, extensible markup language (XML), with the various algorithms being implemented with any combination of data structures, objects, processes, routines or other programming elements. Further, it should be noted that the present invention may employ any number of conventional techniques for data transmission, signaling, data processing, network control, and the like. Still further, the invention may detect or prevent security issues with a client-side scripting language, such as JavaScript, VBScript or the like.

Additionally, many of the functional units and/or modules herein are described as being "in communication" with other functional units and/or modules. Being "in communication" refers to any manner and/or way in which functional units and/or modules, such as, but not limited to, computers, laptop computers, PDAs, modules, and other types of hardware and/or software, may be in communication with each other. Some non-limiting examples include communicating, sending, and/or receiving data and metadata via: a network, a wireless network, software, instructions, circuitry, phone lines, internet lines, satellite signals, electric signals, electrical and magnetic fields and/or pulses, and/or so forth.

As used herein, the term "network" may include any electronic communications means which incorporates both hardware and software components of such. Communication among the parties in accordance with the present invention may be accomplished through any suitable communication channels, such as, for example, a telephone network, an extranet, an intranet, Internet, point of interaction device (point of sale device, personal digital assistant, cellular phone, kiosk, etc.), online communications, off-line communications, wireless communications, transponder communications, local area network (LAN), wide area network (WAN), networked or linked devices and/or the like. Moreover, although the invention may be implemented with TCP/IP communications protocols, the invention may also be implemented using IPX, Appletalk, IP-6, NetBIOS, OSI or any number of existing or future protocols. If the network is in the nature of a public network, such as the Internet, it may be advantageous to presume the network to be insecure and open to eavesdroppers. Specific information related to the protocols, standards, and application software utilized in connection with the Internet is generally known to those skilled in the art and, as such, need not be detailed herein. See, for example, DILIP NAIK, INTERNET STANDARDS AND PROTOCOLS (1998); JAVA 2 COMPLETE, various authors, (Sybex 1999); DEBORAH RAY AND ERIC RAY, MASTERING HTML 4.0 (1997); and LOSHIN, TCP/IP CLEARLY EXPLAINED (1997), the contents of which are hereby incorporated by reference.

For the purposes of the present game, a standard deck of 52 cards is provided, although the game may be played with a reduced deck (for example, a deck consisting only of court cards). The values allotted to the cards are as in a conventional game of whist, with ace being the highest card, followed by king, queen, then jack, then ten to two in order of face value.

In another embodiment of the invention, more than one deck of cards may be employed. In this embodiment, it is obviously possible for two cards to match (i.e. have the same value in the same suit). In this eventuality, if a player matches the dealer's card, the player loses that trick.

The cards are shuffled prior to play. Shuffling can be achieved by any known method, for example manually or by a shuffling machine. The deck may also be cut prior to play.

The game of the present invention may also be played electronically and/or may be controlled, managed, operated, audited, checked, and/or enforced electronically, such as but not limited to including one or more modules and/or having one or more modules perform one or more of the steps, processes, functions, and/or provide one or more of the features described herein. In such circumstances, any of the features, functions, steps, processes, and the like described herein may be performed and/or facilitated by one or more modules that may be implemented with one or more processors, memory devices, busses, and the like and combinations thereof, including but not limited to non-transitory memory. As a non-limiting example, a computer would control the display of player cards on an appropriate video screen with the player being able to select which of his cards to play. Wagering would be done by entering the wager into the game machine or computer in a conventional manner as is currently done for other games of chance in casinos and other gambling establishments. In view of the foregoing, the use of the term "cards" within the meaning of the present invention relates not only to physical playing cards but also to cards which are simulated in computer form or on a video display for purposes of playing the game as outlined above. Any of the steps/processes/etc. described herein may be performed by one or more modules and may be named as a module, such as but not limited to: a wagering modules for managing wagering, a payout module for managing payouts, a display modules for managing a display of the game, a deck module for managing a virtual deck to be played with, a game rules module for managing and/or enforcing game rules within the computing environment, a trick determination module for determining if a trick is won or not, a trick allotment module for allotting one or more tricks to one or more players, a player module for managing one or more players and/or player accounts associated with the game, and/or etc. Modules may be in sufficient communication with other modules and/or with physical devices such as but not limited to displays, keyboards, mice, non-transitory memory, communication devices, processors, busses, and the like and combinations thereof to perform the functions, processes, steps, and/or to provide the features and/or benefits described herein.

Any number of players may play the game, although the maximum number of players will be dictated by the number of cards in the deck. Thus, for a standard deck of 52 cards, a maximum of 16 players is possible in order for each player and the dealer to have three cards initially.

As is usual in casinos and other gambling establishments, wagering may be conducted using cash, but will more often be conducted using chips or tokens representing amounts of actual money.

The base wager is a requisite for players wishing to participate in the game. Usually, this will be fixed by the dealer, casino or gambling establishment, but may be agreed amongst the players.

Figure 3:
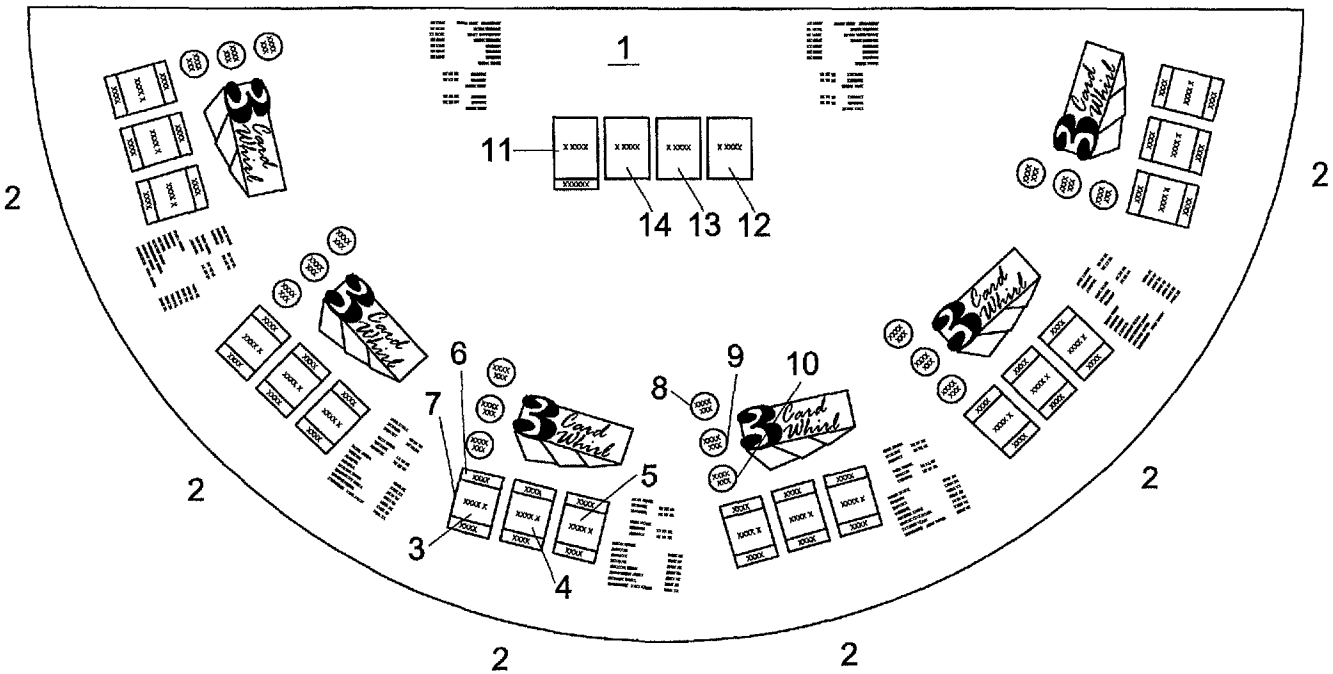
FIG. 3 is a plan view of the game table provided for the present game, showing its various features.

Referring now to FIG. 3, the players are usually seated around the periphery of a table. As is common in casinos and other gambling establishments, the table may be semi-circular in design. The dealer is seated at the mid-point of the straight side of the semi-circle at (1), with the players seated evenly-spaced around the circumference at player locations (2). Although six player stations are featured in the embodiment shown, any number may be provided.

A base wager is a requisite for players wishing to participate in the game. Usually, this will be fixed by the dealer, casino or gambling establishment, but may be agreed amongst the players. The players place their base wager on base wager box (10) (the base wager is also referred to as the "ante bet"). This is shown in detail in FIG. 1.

The dealer then deals the cards. Usually, he will deal three cards face down to each player in turn, starting with the player to his left, and continuing around the table in a clockwise fashion, dealing his own card last. However, in some variations of the game, the players are dealt one card at a time. This process is repeated until all players and the dealer have been dealt three cards face down.

In one variant of the game, the dealer then turns over a further card, so its value is visible to all the players, and places it in trump box (11). The suit of this card determines which suit will be trumps. However, in an alternative variant of the game, the trump suit may be determined in another way, for example by means of a set rota (e.g. clubs, then diamonds, then hearts, then spades, and finally no trumps), by means of an auction or by random device (for example, a die).

The players then inspect their own hand of cards. In one embodiment of the invention, the dealer is also permitted to examine his hand. However, in one non-limiting example, the dealer is not permitted to examine his hand and instead plays his cards without the opportunity of inspecting them ("blind"). At this stage, each player is required to place a further wager if he wishes to join in the following card play, or he may elect not to play, in which case he takes no further part in that round of the game, and loses his base wager, which is retained by the bank. The further wager is placed in box (9) (the further wager is also referred to as the "play bet").

The further wager may be variable, so that participating players can place a wager dependent on the perceived strength of their hand. The casino or gambling establishment may declare a minimum and/or maximum bet. In one non-limiting example, the further wager is fixed at the same level as the base wager.

Figure 2:
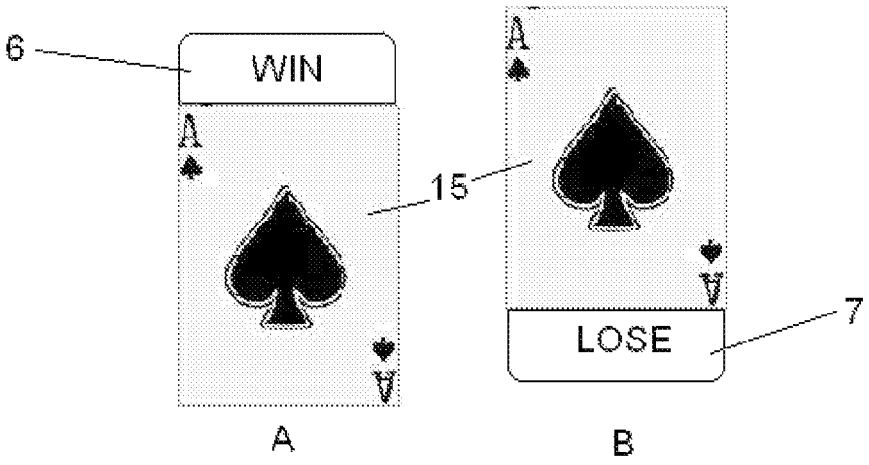
FIG. 2 shows a detail of a player's station, with a card indicating a winning (A) and losing (B) trick.

Play commences with the dealer turning his first card (i.e. the first card he was dealt) to reveal its value. The card is placed in the dealer's "play 1" box (12). The participating players then play one card each. If they are able, players must play a card of the same suit (i.e. clubs, diamonds, hearts or spades) as the card played by the dealer ("follow suit"). If they are unable to follow suit, they may either a) discard a card of another suit, or b) play a card of the trump suit. The player places his card face up in his "play 1" box (3). If the player can beat the dealer's card they place their card on the table in the "play 1" box (3) so the "WIN" sign (6) is visible. If they cannot beat the dealer they must place the card on the table in the box so the "LOSE" sign (7) is visible The winning and losing placement of an exemplary card (15) (here, the ace of spades), is shown in FIG. 2. In FIG. 2(A), the card (15) is placed to conceal "LOSE" sign (7) and reveal "WIN" sign (6). This indicates that the player has won that trick. In FIG. 2(B), meanwhile, the card (15) is placed to conceal "WIN" sign (6) and reveal "LOSE" sign (7). This indicates that the player has lost that trick.

In one non-limiting embodiment of the game, if a player is unable to follow suit, he is required to play a card of the trump suit.

As the objective of the game from the player's perspective is simply to beat the dealer's card, the order in which the players play their cards is not relevant. All players may play their cards simultaneously. However the order of card play may be pre-determined, e.g. the player to the dealer's left follows the dealer's lead. Subsequent players take their turns in a clockwise direction around the table, culminating in the player on dealer's right. In alternative versions of the game, play may be in some other order.

A trick has been played when all participating players and the dealer have played one card each, and the winning players determined.

The dealer then leads a second card from his hand, being the second card he was dealt. He places this in the dealer's "play 2" box (13). Play continues as for the first trick, with each participating player trying to beat the dealer's card whilst following suit if possible, or playing a card of the trump suit. Player's cards for the second trick are placed in their respective "play 2" boxes (4), again positioning the card to reveal either the "WIN" or "LOSE" sign.

The dealer then leads the final card from his hand, being the last card he was dealt. He places this in the dealer's "play 3" box (14). Play continues as for the previous two tricks, with each participating player trying to beat the dealer's card whilst following suit if possible. Player's cards for the third trick are placed in their respective "play 3" boxes (5), again positioning the card to reveal either the "WIN" or "LOSE" sign.

The payout to each player receives is calculated according to how many tricks each player has won. In one embodiment, players winning zero or one trick receive no payout, whereas players winning two or three tricks receive a payout.

In one embodiment, players winning two or three tricks receive a payout comprising the base wager and a multiple of the further wager. In one non-limiting example, the payout for winning three tricks is higher than that for winning two tricks.

In one non-limiting example, the payout for winning two tricks is between one and three times the further wager, plus optionally the base wager. In one non-limiting embodiment, the payout for winning two tricks is between one and three times the further wager, between two and three times, and/or two times the further wager. The payout for winning two tricks may be two times the further wager plus the base wager.

In one non-limiting example, the payout for winning three tricks is between two and four times the further wager, plus optionally the base wager. In one non-limiting embodiment, the payout for winning three tricks is between three and four times the further wager, and/or three times the further wager. The payout for winning three tricks may be three times the further wager plus the base wager.

According to one non-limiting embodiment, the payout scheme for the card game of the invention is as follows: [0056] nothing if the player has won zero or one trick, [0057] twice the further wager plus the base wager if the player has won two tricks, [0058] three times the further wager plus the base wager if the player has won three tricks.

It has been found that if the payout is in accordance with the above formula, the house advantage is acceptable in the long term, whilst at the same time offering player the possibility of a large short-term payout.

In an optional embodiment, the invention further provides a card game as set out above, having the additional feature of a bonus wager.

The bonus wager allows players to bet before they have seen their cards on the value and distribution of the cards their hand will contain. The bonus wager is optional, and must be made at the same time as the base wager. The bonus wager is placed in bonus wager box (8).

The bank pays out on the bonus bet based on the cards contained in the player's hand in accordance with a predetermined hierarchy. This hierarchy, in a non-limiting embodiment, is that used in poker style games.

A non-limiting payout scheme for the bonus wager is as shown in Table 1.

TABLE 1

| Hand | Payout |
|---|---|
| Pair (two cards having the same value) | 1 × Bonus Wager |
| Flush (all cards of the same suit) | 3 × Bonus Wager |
| Straight (three cards of any suit in sequence) | 5 × Bonus Wager |
| Flush of trumps (three cards of trump suit) | 10 × Bonus Wager |
| Three of a kind (three cards having the same value) | 20 × Bonus Wager |
| Straight Flush (three cards of the same suit in sequence) | 30 × Bonus Wager |
| Straight Flush of Trumps (three cards of same suit in sequence) | 100 × Bonus Wager |

The payout in respect of the bonus wager is only in respect of the highest winning hand—for example, where the player has a straight flush, the player receives only the payout for a straight flush (that is, thirty times the bonus wager) rather than the payout for a straight flush, a straight and a flush (i.e. 30+5+3=38 times the bonus wager).

The payout of the bonus wager will normally be determined when all the cards have been played, and are accordingly visible to the players.

In one variation of the game, players may participate in the bonus wager without being required to place a play wager. This allows for the possibility of a player winning money on a hand containing only low cards (for example, a pair of twos).

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. The invention is not to be restricted to the specific forms shown or uses mentioned, except as defined in the accompanying claims, wherein various portions have been separated for clarity of reading and not for emphasis.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

Thus, while the present invention has been fully described above with particularity and detail, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A method for playing a card game played by at least one player against a dealer using a video display and a computer, comprising:

i) providing and shuffling a virtual deck of cards through a computer;

ii) entering a base wager into the computer memory;

iii) displaying, on a video display, a hand of three cards to a player;

iv) displaying a trump suit on the video display;

v) entering a further wager into the computer memory;

vi) displaying a lead card, then each of the other participating players playing one card from their hand following suit of the lead card if possible, or if it is not possible to follow suit, either playing a card of the trump suit, or discarding a card from another suit;

vii) after each player has played a card, electronically determining and allotting each player: one trick if the player has played a card of the same suit as the lead card having a higher numerical value than the lead card; one trick if the player has played a card of the trump suit if the lead card was not of the trump suit; otherwise, allotting that player no trick;

viii) repeating steps vi) to vii) until all cards in each hand have been played;

ix) electronically determining how many tricks have been won by each player;

x) making a payout, through the computer, to each player dependent on the number of tricks that player has won.

2. The method according to claim 1, wherein the lead cards are played randomly.

3. The method according to claim 1, wherein the lead cards are played in an order determined before play begins.

4. The method according to claim 1, wherein the trump suit is determined at random by exposing the value of a further card from the virtual deck after the hands have been dealt.

5. The method according to claim 1, wherein a payout is made to players winning two or three tricks, and no payout is made to players winning zero or one trick.

6. The method according to claim 5, wherein the payout comprises the base wager plus a multiple of the further wager.

7. The method according to claim 6, wherein the payout to players winning two tricks is twice the further wager plus the base wager, and the payout to players winning three tricks is three times the further wager plus the base wager.

8. The method according to claim 1, further comprising the opportunity for a player to place a bonus bet prior to having sight of his hand, with the payout calculated based on a pre-determined hierarchy of hands.

* * * * *